US011959347B2

(12) United States Patent
Haugland et al.

(10) Patent No.: US 11,959,347 B2
(45) Date of Patent: Apr. 16, 2024

(54) DUMP BAILER AND LUBRICATOR ASSEMBLY FOR FILLING THE DUMP BAILER

(71) Applicant: Altus Intervention (Technologies) AS, Stavanger (NO)

(72) Inventors: Lasse Haugland, Bryne (NO); Espen Osaland, Sandnes (NO); Bard Martin Tinnen, Stavanger (NO)

(73) Assignee: Altus Intervention (Technologies) AS, Stavanger (NO)

( * ) Notice: Subject to any disclaimer, the term of this patent is extended or adjusted under 35 U.S.C. 154(b) by 109 days.

(21) Appl. No.: 17/768,032

(22) PCT Filed: Oct. 9, 2020

(86) PCT No.: PCT/NO2020/050246

§ 371 (c)(1),
(2) Date: Apr. 11, 2022

(87) PCT Pub. No.: WO2021/075973

PCT Pub. Date: Apr. 22, 2021

(65) Prior Publication Data

US 2023/0065388 A1 Mar. 2, 2023

(30) Foreign Application Priority Data

Oct. 17, 2019 (NO) ..... 20191237

(51) Int. Cl.
*E21B 27/02* (2006.01)
*E21B 34/06* (2006.01)

(52) U.S. Cl.
CPC ..... *E21B 27/02* (2013.01); *E21B 34/06* (2013.01)

(58) Field of Classification Search
CPC ..... E21B 27/02; E21B 34/06
See application file for complete search history.

(56) References Cited

U.S. PATENT DOCUMENTS

| | | | |
|---|---|---|---|
| 2,170,355 | A | 8/1939 | Stephens |
| 2,670,225 | A | 2/1954 | McKinney |
| 3,556,215 | A | 1/1971 | Owens |

(Continued)

FOREIGN PATENT DOCUMENTS

| | | | |
|---|---|---|---|
| EP | 1590550 | A2 | 11/2005 |
| WO | 0066878 | A1 | 11/2000 |

(Continued)

*Primary Examiner* — Taras P Bemko
(74) *Attorney, Agent, or Firm* — GableGotwals

(57) ABSTRACT

A dump bailer for being filled with a flowable material in a lubricator assembly and for depositing the flowable material in a wellbore, wherein the dump comprises a filling valve for filling flowable material into the dump bailer and a means for orientation of the dump bailer along a longitudinal axis. The invention also relates to a lubricator assembly configured to allow filling a flowable material into a dump bailer positioned within the lubricator assembly, wherein the lubricator assembly comprises an inlet for injection of flowable material and a guide for providing the dump bailer with a correct position and orientation. The invention further relates to a method for filling a flowable material into a dump bailer positioned within a lubricator assembly and for depositing the flowable material in a wellbore.

19 Claims, 6 Drawing Sheets

(56) References Cited

U.S. PATENT DOCUMENTS

| | | | | |
|---|---|---|---|---|
| 4,696,343 | A | 9/1987 | Anderson et al. | |
| 5,048,603 | A | 9/1991 | Bell et al. | |
| 11,053,773 | B2 * | 7/2021 | Beach | E21B 27/02 |
| 2009/0266546 | A1 | 10/2009 | Hill et al. | |
| 2012/0160483 | A1 * | 6/2012 | Carisella | E21B 27/02<br>166/373 |
| 2013/0277047 | A1 * | 10/2013 | Kuhn de Chizelle | E21B 17/203<br>166/305.1 |
| 2014/0318782 | A1 | 10/2014 | Bourque | |
| 2015/0292288 | A1 | 10/2015 | Kasperski et al. | |
| 2017/0175471 | A1 * | 6/2017 | Boleyn, Jr. | E21B 27/02 |
| 2017/0306714 | A1 * | 10/2017 | Haugland | E21B 33/1275 |
| 2019/0169955 | A1 | 6/2019 | Knight et al. | |

FOREIGN PATENT DOCUMENTS

| | | | |
|---|---|---|---|
| WO | 03070565 | A2 | 8/2003 |
| WO | 2014084807 | A1 | 6/2014 |
| WO | 2016053113 | A1 | 4/2016 |
| WO | 2017118727 | A1 | 7/2017 |
| WO | 2019100154 | A1 | 5/2019 |

* cited by examiner

DUMP BAILER AND LUBRICATOR ASSEMBLY FOR FILLING THE DUMP BAILER

CROSS-REFERENCE TO RELATED APPLICATIONS

This United States application is the National Phase of PCT Application No. PCT/NO2020/050246 filed 9 Oct. 2020, which claims priority to Norwegian Patent Application No. 20191237 filed 17 Oct. 2019, each of which is incorporated herein by reference.

The invention relates to a dump bailer for being filled with a flowable material in a lubricator assembly and for depositing the flowable material in a wellbore. The invention also relates to a lubricator assembly configured to allow filling a flowable material into a dump bailer positioned within the lubricator assembly, and to a method for filling a flowable material into a dump bailer positioned within a lubricator assembly and for depositing the flowable material in a wellbore.

When permanently plugging hydrocarbon wells, there are certain regulatory requirements that must be complied with. Only when wells are properly plugged can well construction removal be performed. With today's technology, a lot of this activity is done with the drilling equipment. This equipment is very heavy and is operated by a large number of workers.

The plugging preparation work is usually done with lighter equipment such as wireline services. Coiled tubing can also be used, but due to the large scope of this equipment it is not appropriate. Typical preparation work performed with wireline is logging of the cement column in the annulus, inspection of production pipes, checking that plugging equipment can be installed at the desired depth, and checking condition of production pipes, for example corrosion and or degree of deposits on pipe wall. Preparation work may also involve removal of impurities so that mechanical barrier plugs can be installed at the desired depth.

Since wireline services are very cost-effective relative to drilling packages, it is desirable to carry out as much work as possible using wireline services. Several wireline tools exist for depositing a flowable material, such as cement slurry, in a wellbore. However, due to its large volume, placement of 50 meters of cement plug is still an activity only for coil tubing or drilling packages, as no wireline tools exist which can place such large volumes effectively (a 50 meters cement plug in 7 inches tubing is 970 litres). A single container for containing this volume would be too long for practical handling.

U.S. Pat. No. 4,696,343A discloses a wireline dump bailer for placing a cement slurry on a retainer in a wellbore, wherein the cement slurry is deposited by exploding a detonator. This will result in an uncontrolled deposition and reloading of the detonator at the surface will be time-consuming, since the operator would have to open the lubricator and release the pressure inside to reload.

US2019169955A1 discloses an apparatus for injecting a sealing mixture into a well, wherein the sealing mixture is released from the apparatus using compressed gas. This will also result poor control of the injection, and the apparatus will not be able to contain enough sealing mixture to set a cement plug of the required thickness.

WO2016053113A1 discloses a dump bailer arrangement with a displacement piston in the flow path. This arrangement has several disadvantages, especially the filling could only be done taking the system out of the well.

Displacement piston, wiper plug, swab plug, pipe dart etc, the arrangement dividing the substances preventing mixture inside the dump bailer arrangement has many names and embodiments but are in principle the same.

The dump bailer may also be sluiced into the well using a deployment BOP system, but this is a complex arrangement which is not advantageous to use.

The invention has for its object to remedy or to reduce at least one of the drawbacks of the prior art, or at least provide a useful alternative to prior art. The object is achieved through features, which are specified in the description below and in the claims that follow. The invention is defined by the independent patent claims, while the dependent claims define advantageous embodiments of the invention.

In a first aspect, the invention relates to a dump bailer for being filled with a flowable material in a lubricator assembly and for depositing the flowable material in a wellbore, wherein the dump bailer comprises:

- a main chamber divided by a longitudinally displaceable and sealing wiper plug into an upper chamber and a lower chamber for containing the flowable material;
- a pump for pumping wellbore fluid from a pump inlet to the upper chamber;
- a first tensioned valve system configured so that, when the pump is active, liquid communication between the pump and the upper chamber is open while liquid communication between the upper chamber and the surroundings is closed, and when the pump is inactive, liquid communication between the pump and the upper chamber is closed while liquid communication between the upper chamber and the surroundings is open;
- a second tensioned valve system configured so that liquid communication between the lower chamber and an outlet of the dump bailer is open when the pump is active and closed when the pump is inactive;
- a filling valve for filling flowable material into the lower chamber while preventing flowable material exiting the lower chamber through the filling valve; and
- a means for orientation of the dump bailer along a longitudinal axis.

This configuration of the dump bailer has several advantages. For example, it allows the dump bailer to be filled with flowable material while the dump bailer is positioned inside a complementary lubricator assemble which has a higher pressure than ambient pressure, typically at wellbore shut-in pressure. Filling of the dump bailer may thereby be performed while the lubricator assembly is connected to the wellbore and the dump bailer in completely positioned inside the lubricator assembly, i.e. without any portions of the dump bailer extending from the lubricator assembly. The means for orientation allows the dump bailer to be positioned and orientated such that the filling valve matches an inlet for injection the flowable materials through a wall of the lubricator assembly, whereby flowable material may be filled into the lower chamber via the filling valve. Before filling of the dump bailer, the wiper plug will be positioned at the bottom of the main chamber, whereby the lower chamber is non-existing or very small, and the upper chamber fills the entire or almost the entire main chamber. When filling of the bailer starts by flowable material being injected into the lower chamber through the filling valve, the wiper plug will be displaced upwards within the main chamber as flowable material is filling the lower chamber. The volume of the lower chamber thereby increases, while the volume of the upper chamber decreases. The content of the upper chamber, which is typically wellbore fluid, will be emptied through the first tensioned valve system. Since the pump is not active during filling of the dump bailer, liquid communication between the upper chamber and the surrounding is open. The force of the second tensioned valve system may be so large that it keeps the liquid communication between the lower chamber and the outlet closed during filling. The force may typically be several hundred kg. Alternatively, or additionally, the second tensioned valve system may include a locking mechanism for locking the second tensioned valve system in closed position during filling of the dump bailer. In this way the second tensioned valve system may be required to withstand a smaller pressure than it would have been required to without the locking mechanism, which therefore puts less requirements on the second tensioned valve system. The dump bailer is full when the wiper plug reaches the top of the main chamber. This results in an increase in filling pressure, which may be detected by e.g. an external pump used for filling of the dump bailer, and filling can be stopped.

When the dump bailer is filled with flowable material, it is ready to be lowered into the wellbore to deposit the flowable material at a desired depth. The wiper plug seals the content of the lower chamber from the upper chamber, the filling valve allows only flow into the lower chamber, and the second tensioned valve system is configured so that liquid communication between the lower chamber and the outlet is closed when the pump is inactive, so the flowable material inside the lower chamber of the dump bailer is completely sealed. Unwanted leakage of the flowable material, for example during the lowering of the dump bailer into the wellbore, is thereby avoided, and positive displaced on the flowable material by the pump is required. The depth of the dump bailer in the wellbore may be measured using e.g. equipment such as a gamma ray logging tool and/or casing collar locator. The flowable material may thereby be deposited at a very well-determined depth.

Deposition may be initiated by starting the pump in the dump bailer, which causes the first tensioned valve system to open for liquid communication between the pump and the upper chamber while closing for liquid communication between the upper chamber and the surroundings. The effect of starting the pump is thereby to pump liquid from the surroundings, typically wellbore fluid, into the upper chamber. The pressure in the upper chamber will be transferred to the lower chamber through the longitudinally displaceable and sealing wiper plug. Therefore, if the pump pressure increases sufficiently for the force of the second tensioned valve system to be overcome, liquid communication between the lower chamber and the outlet of the dump bailer will be allowed. The flowable material in the lower chamber will thereby flow out of the outlet and be deposited in the wellbore.

An advantage of the present configuration of the dump bailer is that there is a very large degree of control of the deposition of the flowable material, since it will only be deposited when the pump is active, and the rate of deposition is controlled by the pump. As soon the pump is stopped, deposition of the flowable material will also stop, and further leakage from the dump bailer is avoided.

The dump bailer according to the invention is therefore able to be filled with flowable material in the lubricator assembly at the surface, be lowered into the wellbore without leakage of the flowable material, accurately and controllably deposit the flowable material at the desired depth, be withdrawn to the lubricator assembly and refilled at wellbore shut-in pressure, i.e. without opening the lubricator assemble to the surroundings, and then continue the process with another round of deposition. Pressure tests of the different valves in the dump bailer may be performed at the surface before the dump bailer is refilled. In this way it is possible to deposit a very large amount of flowable material in the wellbore at a very specific depth with a relatively short period of time. By not having to open the lubricator assembly toward the surroundings and/or dissemble the lubricator assembly for refilling, the filling process will be much faster than prior art dump bailers. Therefore, the dump bailer on wireline will be able to compete in the speed and costs compared to using drilling equipment or coiled tubing for depositing large volumes of flowable material.

A typical application of the dump bailer will be plugging of a wellbore, where the flowable material is cement slurry or similar. For this application, several rounds of deposition of cement slurry using the dump bailer will typically be necessary, as a dump bailer able to contain the required volume of cement slurry is not possible, or at least not suitable for practical considerations, as deposition of a plug of 50 meters would require the dump bailer to be much longer than this. Using the dump bailer according to the invention, it will be possible to produce a plug within such a short time that it may be more cost-effective than using e.g. drilling equipment or coiled tubing. Wireline equipment is typically already in position on the oil or gas rig, whereas coiled tubing requires much time for transportation and installation. Since the dump bailer may be filled at shut-in pressure in the lubricator assembly, it can be refilled rapidly, and the subsequent round of deposition in the wellbore may be performed before the cement slurry of the previous round has cured. The result will thereby be a single plug without any weak interfaces between cement portions from different rounds.

The first tensioned valve system of the dump bailer may for example comprise a first valve member which is spring-loaded towards the pump, whereby, when in passive position, the first valve member is blocking a port for liquid communication between the pump and the upper chamber, while another port for liquid communication between the upper chamber and the surroundings is open. When the pump is started, the pressure above the first spring-loaded valve member increases, which causes the first valve member to be disco placed in the direction opposite to the spring force, whereby it blocks a port for liquid communication between the upper chamber and the surroundings while at least partly opening the port for liquid communication between the pump and the upper chamber.

The second tensioned valve system may for example comprise a second valve member which is spring-loaded against the lower chamber. The force of the spring should be large enough to avoid that it opens under the weight of the flowable material inside the lower chamber, yet small enough to be overcome by the pump pressure. The area of the second valve member may be substantially equal to the area of the wiper plug for obtaining correct the pressure balance. When the second valve member is displaced against the spring force, a port towards the outlet is opened, for example one or more channels carved into a valve housing around the second valve member. In one embodiment, the second tensioned valve system comprises a locking mechanism for locking the second tensioned valve system in closed position during filling of the dump bailer. The locking mechanism may for example include a first pin extending from the filling valve and being configured to engage with a cap, a hole or similar of a second pin connected to the second valve member. In this way, when the filling valve is opened, the engagement of the first pin with the second pin thereby prevents the second valve member from being displaced downwards and allowing liquid communication between the lower chamber and the outlet of the dump bailer.

There is also disclosed a further dump bailer for depositing the flowable material in a wellbore, wherein the further dump bailer comprises:

- a main chamber divided by a longitudinally displaceable and sealing wiper plug into an upper chamber and a lower chamber for containing the flowable material;
- a pump for pumping wellbore fluid from a pump inlet to the upper chamber;
- a first tensioned valve system configured so that, when the pump is active, liquid communication between the pump and the upper chamber is open while liquid communication between the upper chamber and the surroundings is closed, and when the pump is inactive, liquid communication between the pump and the upper chamber is closed while liquid communication between the upper chamber and the surroundings is open;
- a second tensioned valve system configured so that liquid communication between the lower chamber and an outlet of the dump bailer is open when the pump is active and closed when the pump is inactive;

The further dump bailer may be particularly beneficial in situations where pressure control equipment on the surface is not needed or is just a precaution. In these situations, the further dump bailer may be longer, whereby reduced number of runs are needed to deposit the required volume of flowable materials, for example to create a cement column. It may for example be possible to deploy the entire volume of flowable material into the well in one single run. Typically, the Down Hole Safety Valve (DHSV) will be a part of the well barrier in such scenarios. In one embodiment of the invention, the means for orientation of the dump bailer may comprise an inclined lower surface for orientating the dump bailer using a guide with a matching inclined surface. In this way the dump bailer will orient itself relative to the guide due to gravity. This is a very simple but effective means of orientation. The inclined lower surface may for example by due to a mule shoe, which is a piece of equipment already used for wireline tools. It may therefore be relatively easy and cheap to acquire.

In one embodiment of the invention, the filling valve may be configured to be opened with a dart. In this way it is assured that the filling valve is only opened when desired, and that no wellbore fluid bleeds into the lower chamber while the dump bailer is in the wellbore, e.g. due to pressure fluctuation. It may also ensure that the dump bailer has the correct orientation in the lubricator assembly. If the dump bailer does not have the correct orientation, the dart will encounter the wall of the dump bailer and will not be able to penetrate as deep into the lubricator assemble as required. Alternatively, the filling valve may be a check-valve with a large required opening pressure.

In one embodiment of either dump bailer, the pump may have an exact or a very high degree of control of the rate of the volume displaced by the pump. This will have the advantage that the operator will always know how much flowable material has been deposited. A suitable pump may be a positive displacement pump, for example a progressive cavity pump. In this type of pump one revolution of a shaft corresponds to a very well-determined displaced volume. Therefore, controlling the rotation speed and number directly controls the rate and total volume of displaced volume, corresponding to the rate and total volume of flowable material the deposited in the wellbore.

In either dump bailer a pressure sensor may be placed between the pump and the wiper plug for measuring pump pressure and the pressure of the surroundings as the pump displaces the flowable material out of the dump bailer. In this way the sensor will never come in contact with the flowable material due to its position above the wiper plug.

Either dump bailer may also comprise a propulsion mechanism for moving the dump bailer within the wellbore, for example a wireline tractor. Depositing the flowable material in the wellbore while simultaneously displacing the dump bailer upwards within the well using the tractor in reverse mode may lead to superior control of the displacement.

In a second aspect, the invention relates to a lubricator assembly configured to allow filling a flowable material into a dump bailer positioned within the lubricator assembly, wherein the lubricator assembly comprises:

- an inlet for injection of flowable material through a wall of the lubricator assembly;
- an inlet sealing mechanism for providing a tight liquid communication between the inlet and a filling valve in the dump bailer; and
- a guide for providing the dump bailer with a position and an orientation within the lubricator assembly so that the dump bailer filling valve is positioned correctly for the inlet sealing mechanism to provide a tight liquid communication between the inlet and the filling valve, wherein the inlet sealing mechanism and the guide are operable from the outside of the lubricator assembly.

A lubricator with such a configuration will allow a complementing dumb bailer, e.g. the dump bailer according to the first aspect of the invention, to be filled with flowable material while the lubricator assembly is at wellbore shut-in pressure. The dump bailer may thereby be inserted into the lubricator assembly before filling of the dump bailer, which may make the filling procedure easier and more secure. Filling of the dump bailer may thereby be performed while the lubricator assembly is connected to the wellbore and the dump bailer in completely positioned inside the lubricator assembly, i.e. without any portions of the dump bailer extending from the lubricator assembly. Additionally, the dump bailer may be pressure-tested before filling to assure that all valves are tight and working properly. The risk of leakage of flowable material inside the lubricator is therefore decreased. Another major advantage of the lubricator assembly is that, after the flowable material has been deposited in the wellbore, the dump bailer may be refilled in the lubricator without opening the lubricator assembly to the surroundings. This will greatly speed up the refilling process between subsequent deposition rounds of the dump bailer compared to if the lubricator assembly had to be opened toward the surrounding as in prior art lubricators. This therefore speeding up deposition of flowable material in the wellbore. The lubricator assembly is only required to be opened after the desired number of deposition rounds have been accomplished.

In one embodiment, the guide may comprise an inclined surface for matching an inclined lower portion of the dump bailer. The normal of the inclined surface may for example form an angle relative to a longitudinal axis of the lubricator assembly for matching a mule shoe on the dump bailer, as mule shoes on dump bailers are already used and therefore easy to acquire. Using an inclined surface is a simple and efficient way to provide the correct position and orientation to the dump bailer. When the dump bailer is to be filled, it is lifted inside the lubricator assembly to a height such that it is ensured that the lower portion of the dump bailer is above the guide. Then, operated from the outside of the lubricator assembly, the inclined surface of the guide is displaced into the centre of the lubricator assembly, and the dump bailer is slowly lowered on the inclined surface. The dump bailer will thereby automatically orient itself correctly on the inclined surface, whereby the filling valve of the dump bailer will match the inlet of the lubricator assembly.

In addition to the inclined surface, the lubricator assembly may further comprise a wash line inlet and a wash line outlet for washing at least a portion of the dump bailer by injecting a cleaning liquid through the wash line inlet and letting the cleaning liquid out of the wash line outlet, wherein the inclined surface is configured for guiding the cleaning liquid towards the wash line outlet. This may be particularly advantageous when the dump bailer is refilled with flowable material between two deposition rounds in the wellbore, as any residue from the previous round may be washed off the dump bailer before the subsequent round. In this way the risk of contamination or the deposited flowable material is decreased. Using the inclined surface to guide the cleaning liquid towards the outlet ensures that no residues from the cleaning process is left in the lubricator assembly after cleaning, thereby assuring that no unwanted chemicals are transferred to the wellbore by the dump bailer.

The inlet sealing mechanism may comprise a seal cup which is displaceable within the inlet of the lubricator assembly towards the filling valve of in the dump bailer. In this way, when the dump bailer is correctly positioned and orientated within the lubricator assembly, the seal cup can be displaced towards the filling valve to seal the communication between the inlet of the lubricator assembly and the filling valve of the dump bailer. If the filling valve is a tensioned check valve, filling of the dump bailer may be initiated simply by providing a filling pressure which is large enough to overcome the tension of the check valve. The lubricator assembly may further comprise a dart through the inlet for opening the filling valve of the dump bailer, which is advantageous if the filling valve is configured to be opened with a dart. The dart may be operated from the outside of the lubricator assembly and may function to ensure that the dump bailer indeed has the correct position and orientation. The dart may for example be screwed toward the centre of the lubricator assembly. Since the dart functions to open the filling valve, a lower filling pressure is required than if the filling valve is a tensioned check valve.

In a third aspect, the invention relates to a method for filling a flowable material into a dump bailer positioned within a lubricator assembly and for depositing the flowable material in a wellbore, wherein the method comprises the steps of:

- positioning and orienting the dump bailer within the lubricator assembly such that a filling valve of the dump bailer is positioned correctly relative to an inlet of the lubricator assembly;
- filling the dump bailer with flowable material while the dump bailer is within the lubricator assembly;
- lowering the dump bailer containing the flowable material into the wellbore at a desired depth; and
- depositing the flowable material in the wellbore.

Using this method allows the dump bailer to be filled with the flowable material while positioned inside the lubricator. Filling of the dump bailer may thereby be performed while the lubricator assembly is connected to the wellbore and the dump bailer in completely positioned inside the lubricator assembly, i.e. without any portions of the dump bailer extending from the lubricator assembly. In this way the filling process will be easier, and the risk of spilling of the flowable material will be decreased. The method is therefore particularly suitable for deposition of hazardous chemicals. Typically, during filling of the dump bailer, an equal volume of wellbore fluid is bled off from the lubricator assembly to maintain a correct pressure.

The step of filling the dump bailer with flowable material while the dump bailer is within the lubricator assembly may for example be performed at wellhead shut-in pressure, but it may also be performed at ambient pressure, where the lubricator pressure is bled down to ambient.

In one embodiment, the method may additionally comprise the step of testing at least one valve of the dump bailer while the dump bailer is within the lubricator assembly. This has the advantage that correct function of the valves of the dump bailer may be ensured before filling, whereby the risk of leakage of flowable material inside the lubricator assembly is decreased. If one or more of the valves are not tight, the dump bailer may be removed from the lubricator assembly for further testing and maintenance. This step is typically performed while the pressure of the lubricator assembly is at wellhead shut-in pressure.

In one embodiment, the method may additionally comprise the step of washing at least a portion of the dump bailer while the dump bailer is within the lubricator. This step ensures that the dump bailer is clean before use.

In one embodiment, the step of depositing the flowable material in the wellbore may comprise simultaneously displacing the dump bailer upwards within the well at controlled speed, for example by hoisting the dump bailer using the wireline cable or by driving a wireline tractor that is connected to or forms part of the dump bailer in reverse. In this way the outlet of the dump bailer may be kept close to the upper surface of the deposited material, thereby preventing that the flowable material falls too long a distance at the beginning of the deposition, and/or that the deposited material rises up too high around the dump bailer during deposition. Advantageously, the dump bailer may comprise a pump with control of the rate for depositing the flowable material in a controlled manner, and the speed of displacement of the dump bailer may be selected to match the deposit rate of the flowable material so that the relative distance between the upper surface of the deposited flowable material and the dump bailer is substantially constant during the step of depositing the flowable material in the wellbore while simultaneously displacing the dump bailer upwards within the well. The fall of the flowable material will thereby be substantially constant during deposition. The method may additionally comprise the step of depositing a first portion of the flowable material until the outlet of the dump bailer is covered by the flowable material before the step of depositing the flowable material in the wellbore while simultaneously displacing the dump bailer upwards within the well. In this way, apart from during deposition of the first portion, deposition of the flowable material from the outlet will happen below the surface of the already deposited flowable material, whereby the risk of contamination of the deposited material with contents from the wellbore fluid is decreased. If the speed of displacement of the dump bailer matches the rate of deposition of flowable material, it is ensured that the outlet of the dump bailer is always below the surface of the flowable material.

In one embodiment, the method may additionally comprise the step of pulling the dump bailer into the lubricator assembly after the flowable material has been deposited at the desired depth; and repeating the preceding method steps. This has the advantage that repeated rounds of deposition in the wellbore may be performed without opening the lubricator assembly towards the surroundings, for example if the pressure of the lubricator is maintained substantially at wellhead shut-in pressure when repeating the filling step. As opening of the lubricator assembly is a time-consuming process, not having to do this step saves a lot of time. Deposition of large volumes of flowable material using the method according to the invention, for example when plugging a well, will be much faster than previously possible using wireline. In terms of time and costs, the method may be more efficient than, or at least comparable to, using drilling equipment or coiled tubing. For every time the step of lowering the dump bailer containing the flowable material into the wellbore at a desired depth is repeated, the dump bailer may be lowered so that the outlet of the dump bailer is immersed into the previously deposited flowable material to such an extent that the outlet of the dump bailer is covered by the previously deposited flowable material, before the step of depositing the flowable material in the wellbore while simultaneously displacing the dump bailer upwards within the well. This may ensure that the flowable material is deposited as a single homogenous matter even though it has been deposited over multiple rounds, and that contaminants from the wellbore fluid are not mixed into the deposited flowable material. For example, if the flowable material is cement slurry for forming a plug in the wellbore, immersing a portion of the dump bailer which comprises the outlet will prevent formation of interfaces between each consecutively deposited volumes of flowable material. This process is made possible by the rapid refilling of the dump bailer in the lubricator assembly, typically at wellbore shut-in pressure, since the subsequent deposition can be initiated before the deposited cement slurry cures.

There is also disclosed a further method for depositing a flowable material in a wellbore, wherein the further method comprises the steps of:

filling a dump bailer with flowable material;

lowering the dump bailer containing the flowable material into the wellbore at a desired depth; and depositing the flowable material in the wellbore while simultaneously displacing the dump bailer upwards within the well at a controlled speed.

The step of depositing the flowable material in the wellbore while simultaneously displacing the dump bailer upwards within the well at a controlled speed may for example be performed by hoisting the dump bailer using a wireline cable or by driving a wireline tractor that is connected to or forms part of the dump bailer in reverse. In this way the outlet of the dump bailer may be kept close to the upper surface of the deposited material, thereby preventing that the flowable material falls too long a distance at the beginning of the deposition, and/or that the deposited material rises up too high around the dump bailer during deposition. Advantageously, the dump bailer may comprise a pump with control of the rate for depositing the flowable material in a controlled manner, and the speed of displacement of the dump bailer may be selected to match the deposit rate of the flowable material so that the relative distance between the upper surface of the deposited flowable material and the dump bailer is substantially constant during the step of depositing the flowable material in the wellbore while simultaneously displacing the dump bailer upwards within the well. The fall of the flowable material will thereby be substantially constant during deposition. The further method may additionally comprise the step of depositing a first portion of the flowable material until the outlet of the dump bailer is covered by the flowable material before the step of depositing the flowable material in the wellbore while simultaneously displacing the dump bailer upwards within the wellbore at a controlled speed. In this way, apart from during deposition of the first portion, deposition of the flowable material from the outlet will happen below the surface of the already deposited flowable material, whereby the risk of contamination of the deposited material with contents from the wellbore fluid is decreased. If the speed of displacement of the dump bailer matches the rate of deposition of flowable material, it is ensured that the outlet of the dump bailer is always below the surface of the flowable material.

The further method may additionally comprise the step of pulling the dump bailer to the surface after the flowable material has been deposited at the desired depth; and repeating the preceding method steps. This may be particularly advantageous if the filling step can be performed relatively quickly. The further method may thereby be used for deposition of large volumes of flowable material, for example when plugging a well. For every time the step of lowering the dump bailer containing the flowable material into the wellbore at a desired depth is repeated, the dump bailer may be lowered so that the outlet of the dump bailer is immersed into the previously deposited flowable material to such an extent that the outlet of the dump bailer is covered by the previously deposited flowable material, before the step of depositing the flowable material in the wellbore while simultaneously displacing the dump bailer upwards within the well at a controlled speed. This may ensure that the flowable material is deposited as a single homogenous matter even though it has been deposited over multiple rounds, and that contaminants from the wellbore fluid are not mixed into the deposited flowable material. For example, if the flowable material is cement slurry for forming a plug in the wellbore, immersing a portion of the dump bailer which comprises the outlet will prevent formation of interfaces between each consecutively deposited volumes of flowable material.

In the following is described an example of a preferred embodiment illustrated in the accompanying drawings, wherein.

Figure 4:
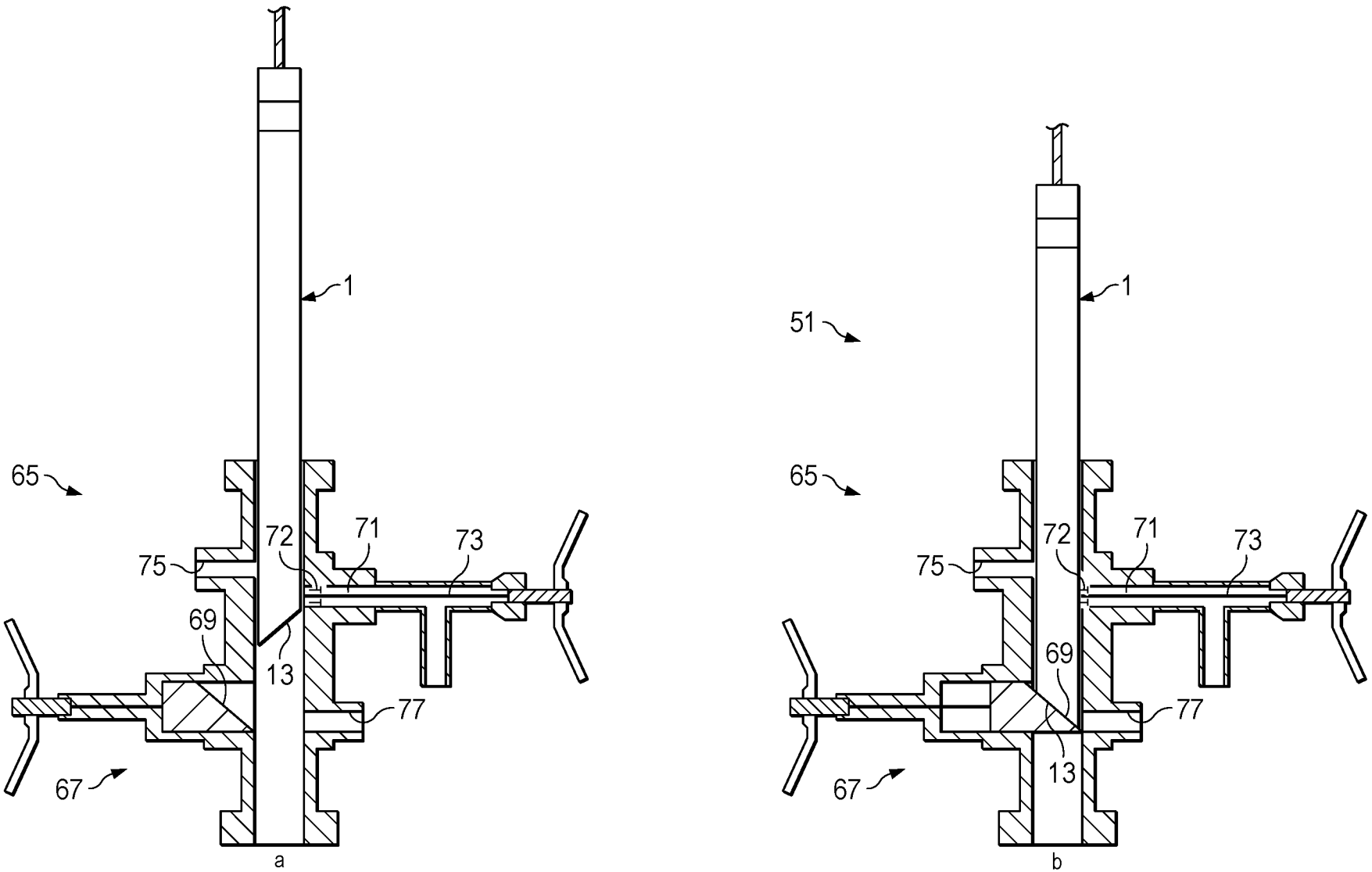

FIG. 4. shows a cross-sectional view of a portion of the lubricator assembly before (FIG. 4*a*) and after (FIG. 4*b*) orientation of the dump bailer in the lubricator assembly.

Figure 5:
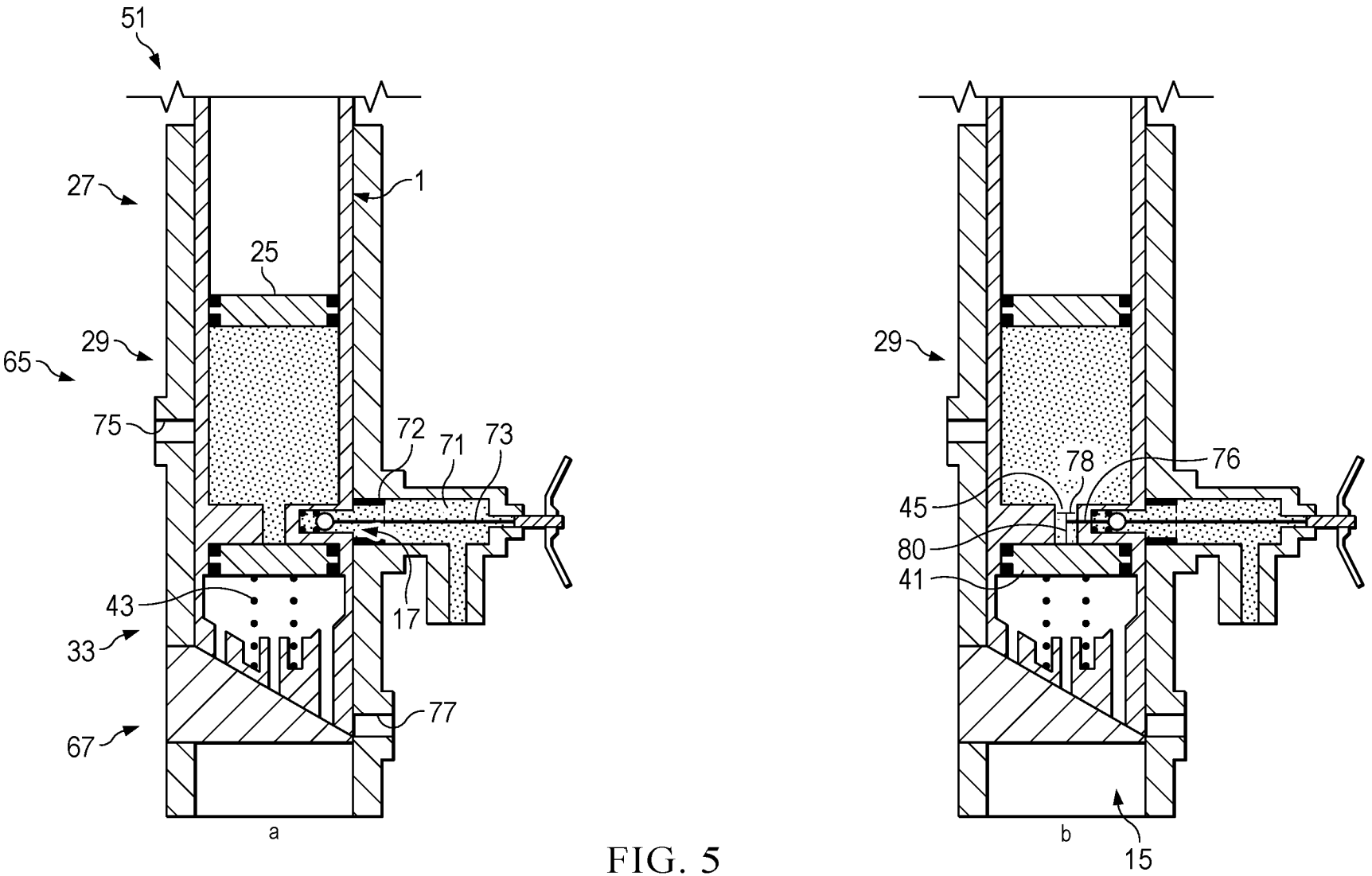
Figure 6:
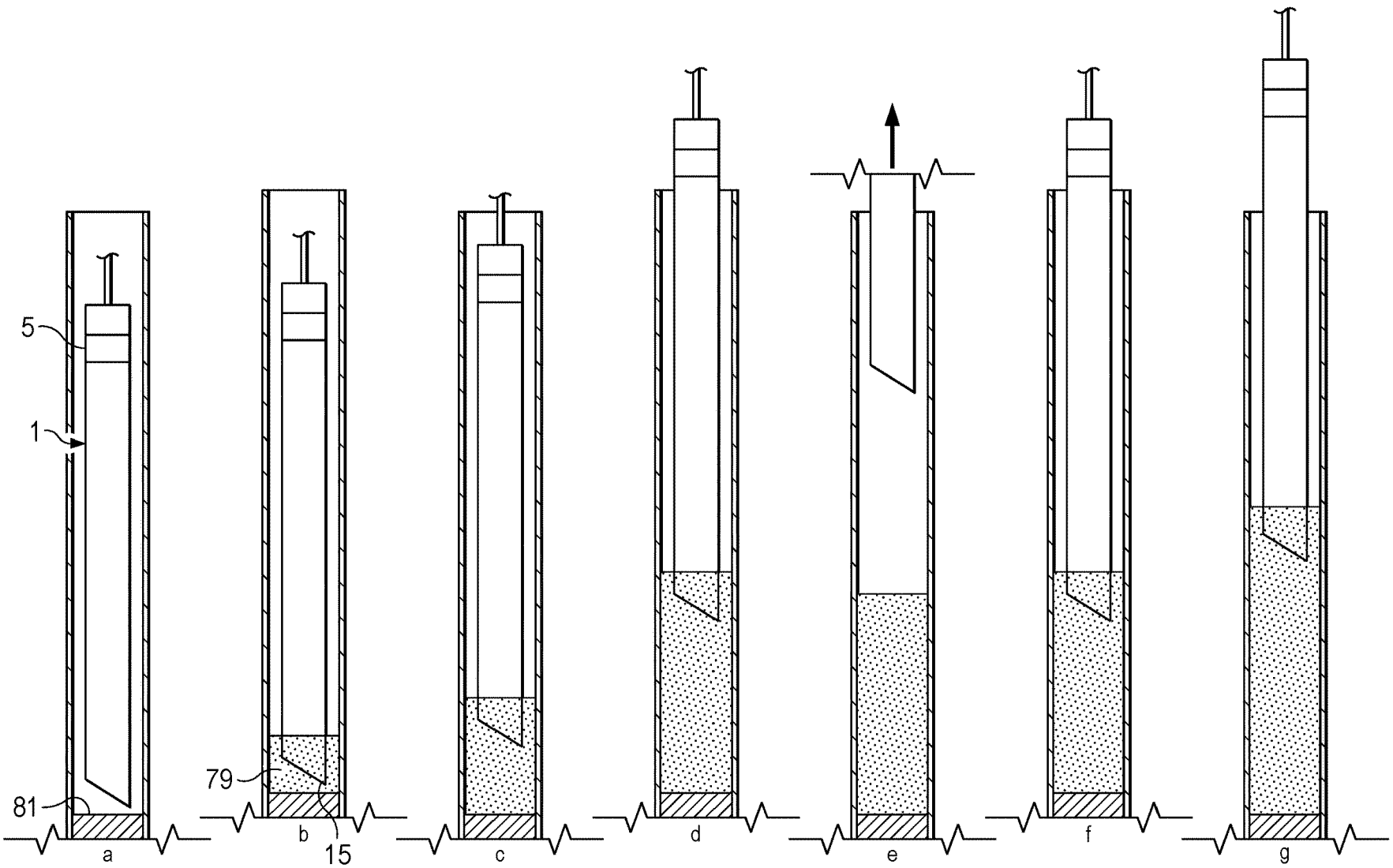

FIG. 5 *a* and *b* show cross-sectional views of a portion of the lubricator assembly and dump bailer during filling of two embodiments of the dump bailer with flowable material; and FIG. 6 shows a method for depositing cement slurry in a wellbore according to the invention.

In the drawings, the reference numeral 1 indicates a dump bailer according to the invention. Identical reference numerals indicate identical or similar features in the drawings. The drawings are presented in a simplified and schematic manner, and the features therein are not necessarily drawn to scale.

Figure 1:
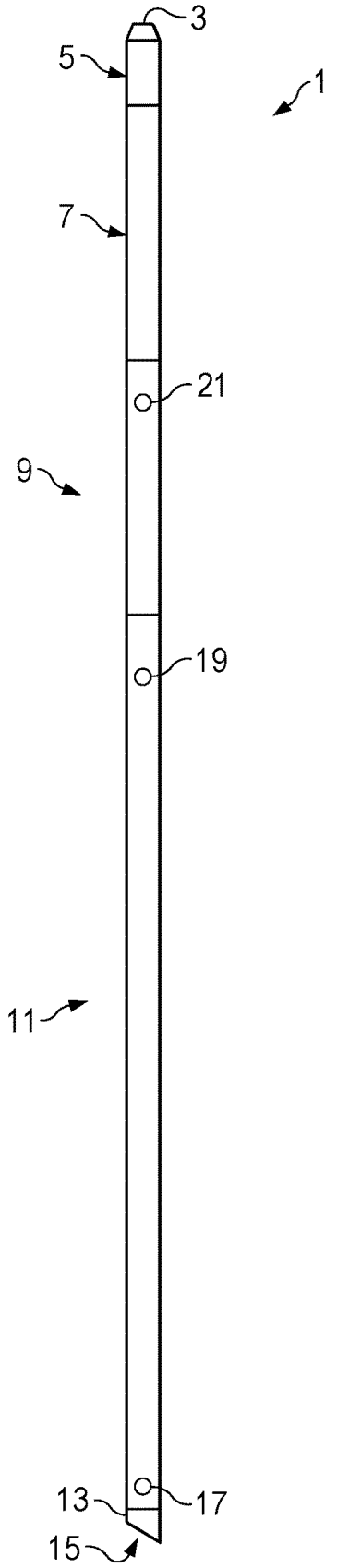
FIG. 1 shows a dump bailer according to the invention.

FIG. 1 shows an overview of a dump bailer 1 comprising a cable head 3 for connection between the dump bailer and the wireline; a depth-measuring tool 5 for measuring the depth of the dump bailer 1, for example a gamma ray logging tool or a casing collar locator; a rotational motor 7 for rotating a shaft of a pump 9; a chamber section 11 comprising the main chamber and the tensioned valve systems; and a mule shoe 13. The mule shoe 13 provides the means for orientation of the dump bailer 1 along its longitudinal axis, as well as an outlet 15 for deposition of flowable material. The chamber section 11 comprises a filling valve 17 for filling the dump bailer 1 with flowable material and a port 19 for liquid communication between the chamber and the surroundings. The pump has an inlet 21 for pumping wellbore fluid into the chamber section 11.

Figure 2:
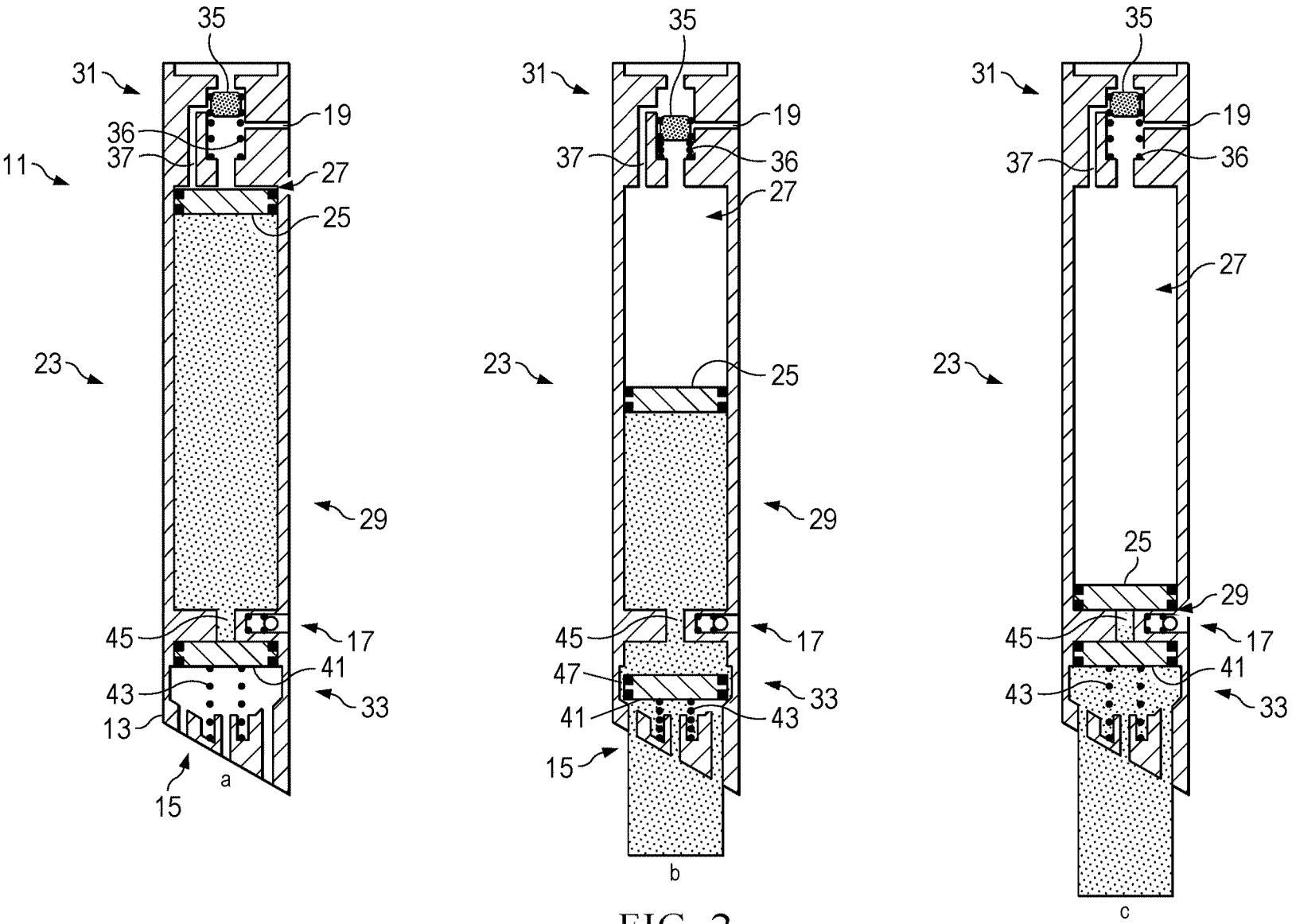
FIG. 2 show cross-sectional view of a portion of the dump bailer when filled with flowable material (FIG. 2*a*), during deposition (FIG. 2*b*), and when deposition is done (FIG. 2*c*)

FIGS. 2*a-c* show a cross-sectional view of the chamber section 11 and mule shoe 13 when the dump bailer 1 is completely filled with flowable material (FIG. 2*a*), during deposition of flowable material when the dump bailer 1 is halfway emptied (FIG. 2*b*), and when the dump bailer 1 is empty (FIG. 2*c*). The chamber section 11 comprises a main chamber 23 which is divided by a longitudinally displaceable and sealing wiper plug 25 into an upper chamber 27 and a lower chamber 29. As the wiper plug 25 is displaced within the main chamber 23, the volumes of the upper 27 and lower 29 chambers are changed. In FIG. 2*a*, the wiper plug 25 is at the top of the main chamber 23, whereby the volume of the upper chamber 27 is substantially zero, while the volume of the lower chamber 29 is almost that of the main chamber 23 (apart from the volume of the wiper plug 25). In FIG. 2*b* the wiper plug 25 has been displaced to the middle of the main chamber 23, whereby the upper 27 and lower 29 chambers have similar volumes. In FIG. 2*c* the wiper plug 25 has been displaced to the bottom of the main chamber 23 so that the volume of lower chamber 29 is substantially zero while the volume of the upper chamber 27 is almost that of the main chamber 23.

The chamber section 11 also comprises a first tensioned valve system 31 and a second tensioned valve system 33. The first tensioned valve system 31 comprises a first valve member 35 which is tensioned with a first spring 36 towards the pump 9. In FIGS. 2*a* and 2*c* the first valve member 35 is in passive position, whereby it is blocking a port 37 for liquid communication between the pump 9 and the upper chamber 27, while another port 19 for liquid communication between the upper chamber 27 and the surroundings is open. When the pump 9 is pumping, as is the situation in FIG. 2*b*, the pressure above the first spring-loaded valve member 35 is increased, which causes the first valve member 35 to be displaced in the direction opposite to the spring force and compress the spring 36. When the first spring 36 is compressed, the port 19 for liquid communication between the upper chamber 27 and the surroundings is blocked by the first valve member 35, while the port 37 for liquid communication between the pump 9 and the upper chamber 27 is open. Wellbore fluid is thereby pumped from the surroundings through the pump 9 and port 37 to the upper chamber 27. The increased pressure in the upper chamber 27 will act on the second tensioned valve system 33 through the wiper plug 25 and flowable material in the lower chamber 29.

The second tensioned valve system 33 comprises a second valve member 41 which is tensioned against the lower chamber 29 with a second spring 43. The area of the second valve member 41 is substantially equal to the area of the wiper plug 25. In FIGS. 2*a* and 2*c* the second valve member 41 is in passive position, thereby blocking a port 45 for liquid communication between the lower chamber 29 and the outlet 15 of the dump bailer 1. The force of the second spring 43 should be large enough to avoid that it opens under the weight of the flowable material inside the lower chamber 29, yet small enough to be overcome by the pressure of the pump 9. When the pump 9 is active, as in FIG. 2*b*, the second valve member 41 is displaced against the force of the second spring 43. This displacement causes the second valve member 41 to reach a position in the second tensioned valve system 33 where channels 47 are carved into the side of the valve housing around the second valve member 41. The flowable material can thereby flow from the lower chamber 29 through the port 45 and channels 47 and out of the outlet 15 for deposition in the wellbore.

When the wiper plug 25 reaches the bottom of the main chamber 23, as in FIG. 2*c*, pressure in the upper chamber 27 increases significantly, and the pump 9 is stopped. The first 35 and second 41 valve members then return to their passive state, whereby the ports 37 and 45 are closed as explained above, while the port 19 for fluid communication between the upper chamber 29 and the surroundings is open to avoid trapping pressure in the dump bailer 1. During the entire process shown in FIG. 2*a-c*, the filling valve 17 is maintained in closed position.

Figure 3:
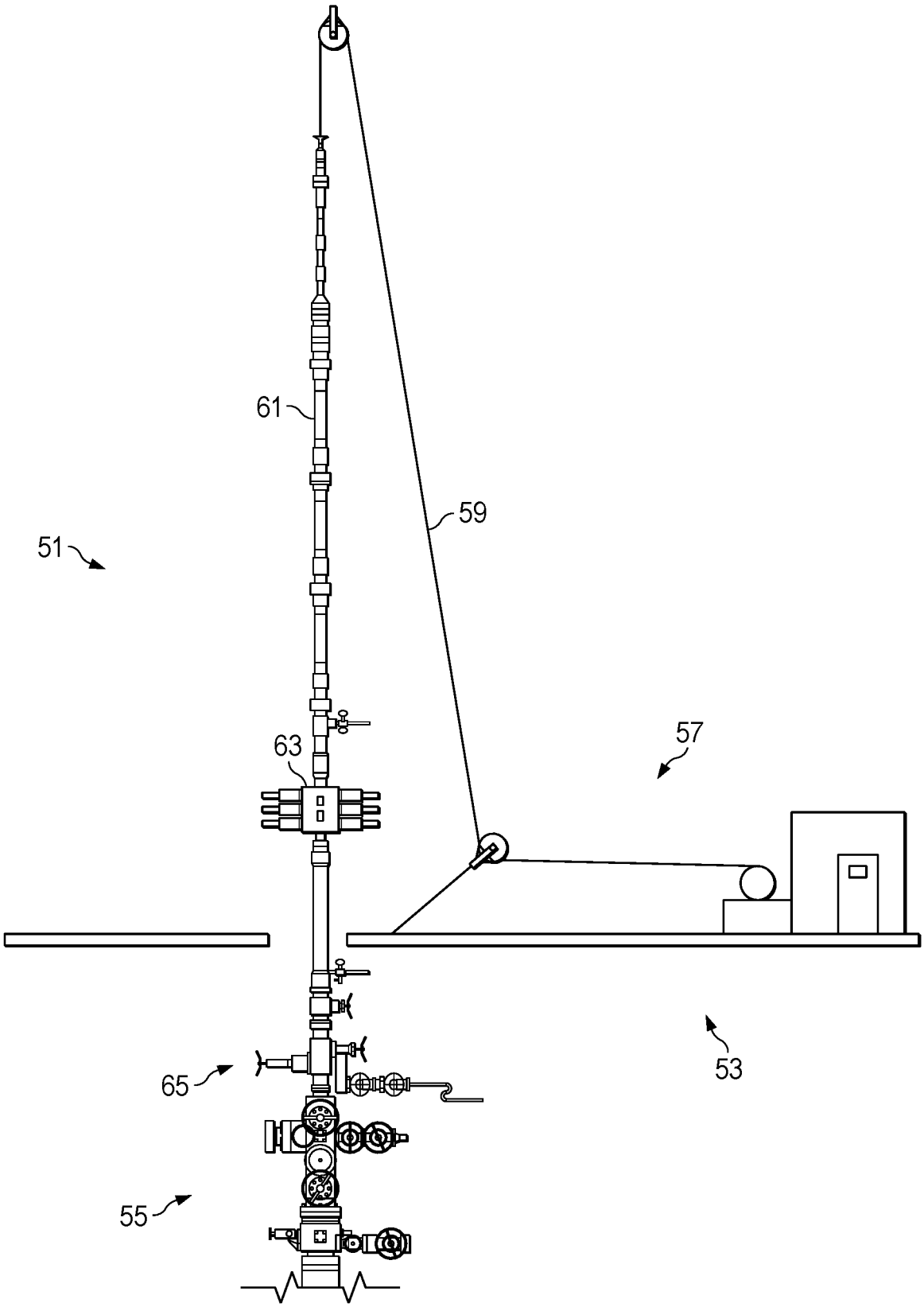
FIG. 3 shows a lubricator assembly according to the invention mounted on a Christmas tree on an oil rig.

FIG. 3 shows a lubricator assembly 51 mounted on a Christmas tree 55 installed on an oil rig 53. A hoisting system 57 is connected to a dump bailer 1 (not visible in this figure) within the lubricator assembly 51 through a wireline 59. In addition to the elongated tubing 61 required to contain the dump bailer 1 and the blow-out preventer 63, the lubricator assembly 51 comprises a filling section 65 positioned between the Christmas tree 55 and the blow-out preventer 63 for filling the dump bailer 1 with flowable material while the dump bailer 1 is at wellbore shut-in pressure within the lubricator assembly 51. The filling section 65 is illustrated with more details in FIG. 4.

FIGS. 4*a-b* show cross-sectional views of the filling section 65 of the lubricator assembly 51 from FIG. 3, together with a dump bailer 1 (not in sectioned view in FIG. 4). The filling section 65 of the lubricator assembly 51 comprises a guide 67 for positioning and orienting a dump bailer correctly within the lubricator assembly 51. In FIGS. 4*a-b* the guide comprises an inclined surface 69 for matching the mule shoe 13 of the dump bailer 1. The filling section 65 of the lubricator assembly 51 additionally comprises an inlet 71 for injection of flowable material, a seal cup 72 for sealing around the filling valve 17, and a dart 73 through the centre of the inlet 71. Both the seal cup 72, the dart 73, and the guide 67 can be operated from the outside of the lubricator assembly 51. During operation of the dump bailer 1 in the wellbore, the guide 67, seal cup 72, and dart 73 are in withdrawn positioned from the centre of the lubricator assembly 51 to allow free vertical movement of dump bailer 1. When the dump bailer 1 is to be filled, it is lifted up into the lubricator assembly 51 so that the bottom of the mule shoe 13 is above the guide 67 as shown in FIG. 4*a*. Then the guide 67 is displaced within the lubricator assembly, and the dump bailer 1 is lowered to land onto the guide 67. Due to the matching inclined surfaces of the guide 67 and the mule show 13, the dump bailer 1 will automatically orient itself within the lubricator assembly 51 as shown in FIG. 4*b*. When the dump bailer 1 is oriented correctly, the seal cup 72 can be displaced to seal the around the filling valve 17, and the dart 73 can be inserted into the filling valve 17 (not visible in the figure) to open it. The dart 73 therefore functions to ensure that the dump bailer 1 has the correct position and orientation within the lubricator assembly 51 for filling the dump bailer 1. The lubricator assembly 51 also comprises a wash line inlet 75 and wash line outlet 77 for washing the lower portion of the dump bailer 1 with a cleaning liquid. The inclined surface of the guide 67 is configured to guide the cleaning liquid out of the wash line outlet 77 to ensure that all residues from the cleaning process are removed from the lubricator assembly 51.

FIGS. 5*a* and *b* show a cross sectional view of a portion of the dump bailer 1 as it is being filled with flowable material in the lubricator assembly 51 as in FIG. 4*b*. The filling valve 17 is held open by the dart 73 to allow the flowable materials to be injected through the filling valve 17 via the inlet 71 of the lubricator assembly 51. The seal cup 72 seals against the surroundings so to prevent flowable material contaminating the lubricator assembly 51, or wellbore fluid form the lubricator assembly 51 contaminating the flowable material. During filling the wiper plug 25 is displaced upwards with the main chamber 23 as the lower chamber 29 is filled with flowable material. As the first tensioned valve system 31 (see FIG. 2) is in passive position, liquid from the upper chamber 27 exits to the surroundings via the port 19. In FIG. 5*a*, the second tensioned valve system 33 will be closed during the filling process due to the spring force of the second spring 43 being much higher than the force resulting from the injection pressure of the flowable material. In FIG. 5*b*, the second tensioned valve system 33 comprises a locking mechanism for locking the second tensioned valve system 33 in closed position during filling of the dump bailer 1. More specifically, the locking mechanism in FIG. 5*b* includes a first pin 76 extending from the filling valve 17 towards the port 45 for liquid communication between the lower chamber 29 and the outlet 15, wherein the first pin 76 engages a cap 78 on a second pin 80 connected to the second valve member 41 when the filling valve 17 is opened. The engagement of the first pin 76 with the cap 78 thereby prevents the second valve member 41 from being displaced downward and allowing liquid communication between the lower chamber 29 and the outlet 15 through the port 45 while the filling valve 17 is open. If such a locking mechanism is used, the second tensioned valve system 33 may be required to withstand a smaller pressure than it would have been required to without the locking mechanism, which therefore puts less requirements on the second tensioned valve system 33 and the second spring 43.

FIGS. 6*a-d* show a method for depositing a cement plug 79 on a retainer 81 in a wellbore using the dump bailer 1. Initially, the dump bailer 1 is lowered into the wellbore to the position of the retainer 81 (FIG. 6*a*). A depth-measuring tool 5 keeps ensures that the correct depth is reached. A small portion of the cement slurry is deposited on the retainer 81 until the cement plug 79 covers the outlet 15 of the dump bailer 1 (FIG. 6*b*). As the dump bailer 1 has complete control of rate of deposition of cement slurry and position of the dump bailer 1, the dump bailer 1 is withdrawn upwards with the same speed as the deposition rate, whereby the outlet 15 of the dump bailer 1 stays immersed in the cement plug 79 during the deposition process (FIGS. 6*c* and *d*). After the first round, the dump bailer is withdrawn to the surface (FIG. 6*e*) and refilled, and then lowered into the wellbore again to continue the deposition process. When using the lubricator assembly according to the invention, the refilling process is sufficiently fast so that the cement plug 79 does not cure during the refilling of the dump bailer 1. Therefore, when the dump bailer 1 returns to the cement plug 79, the dump bailer 1 can be immersed into the cement plug 79 again (FIG. 6*f*) so that the outlet 15 is below the surface, and the process of withdrawal during deposition can continue (FIG. 6*g*). The method of deposition shown in FIG. 6 provides a cement plug 79 with a high quality. For example, since the cement plug 79 does not have time to cure between subsequent rounds, there will not be any weak intern faces due to different times of curing between the cement slurry deposited in different rounds. Additionally, since the outlet 15 of the dump bailer 1 is immersed below the surface of the cement plug 79 during deposition of cement slurry, there will not be mixed any contaminants from the wellbore fluid into to the cement plug 79 during deposition. The result of the deposition is therefore a homogenous cement plug 79 without weak interfaces or contamination.

A typical operation for plugging a wellbore with a cement plug may be:

- Rigging up all pressure control equipment on the well, including the lubricator assembly 51.
- Place the tool string with the dump bailer 1 in the lubricator assembly 51 and pressure test according to procedure.
- If pressure test is ok, equalize the pressure over the valve against the wellbore.
- Engage the guide 67 for providing the dump bailer 1 with the correct orientation, and land and orient dump bailer 1.
- Open filing valve 17 with dart 73 and operate seal cup 72 to seal around filling valve 17 in dump bailer 1.
- Test the connection by bleeding off pressure in the inlet 71 of the lubricator assembly 51 while the wiper plug 25 is in bottom position. The pressure will immediately drop to 0 if sealing is ok. This shows that the wiper plug 25 is sealed, the seal cup seals properly, and the second tensioned valve system of the dump bailer 1 is sealed.
- Fill the dump bailer 1 with cement slurry to maximum capacity. The filling pressure is kept below the opening pressure of the second tensioned valve system 33 to prevent leakage in the lubricator assembly 51. Cement slurry will displace the liquid content above the wiper plug 25 and push it out of the upper chamber 27 through the first tensioned valve system 31 of the dump bailer 1. As it is important to maintain the pressure in the lubricator assembly 51, this is done by regulating a bleeding pressure when the cement slurry is filled into the dump bailer 1.
- When filling is completed, the filling valve 17 is closed by pulling out the dart 73. Cement slurry is now placed in the dump bailer 1 without exposure to equipment and personnel. The passive position of the tensioned valves of the dump bailer 1 holds the cement slurry in the lower chamber 29 of the dump bailer 1.
- The status of the valves in the dump bailer 1 is checked before displacing the guide 67, by starting the pump 9 of dump bailer 1, thereby pressing lightly against the wiper plug 25 which is now in the upper part of the main chamber 23. Press against wiper plug 25 pressurizes the cement slurry in the lower chamber 29. If pressure is kept below the opening pressure of the second tensioned valve system 33, the system should be completely sealed.
- If the test is passed, the tool string is ready.
- Before displacing the guide 67, the wash lines inlet 75 and outlet 77 are opened for simple cleaning in case there has been any unintentional spillage of cement within the lubricator assembly 51.
- When the dump bailer 1 is to be refilled, this is performed using the same setup.
- If there is a desire to clean the inside of the dump bailer 1, this can also be done in the system. Then the dump bailer 1 is filled with a cleaning fluid pumped into the dump bailer 1 through the lubricator assembly 51. When the lower chamber 29 is filled with cleaning fluid, the pump 9 is started to wash out residues that may exist in valves etc. This can be repeated up to several times. Use of acid to weaken and remove old cement slurry is also possible without exposing operators to danger. The acid wears away any residual cement slurry and can help to get the dump bailer 1 back to operational condition quickly and efficiently. If the operation progresses smoothly and a round trip takes a short time, fresh cement slurry may be sufficient to keep the dump bailer 1 operational.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The mere fact that certain measures are recited in mutually different dependent claims does not indicate that a combination of these measures cannot be used to advantage.

The invention claimed is:

1. A dump bailer for being filled with a flowable material in a lubricator assembly and for depositing the flowable material in a wellbore, the dump bailer having an elongated body with a longitudinal axis, said dump bailer comprises:

an inlet and an outlet;

a main chamber having a longitudinally displaceable sealing wiper plug and being divided by the longitudinally displaceable sealing wiper plug into an upper chamber and a lower chamber for containing the flowable material;

a pump for pumping wellbore fluid to the upper chamber, the pump is positioned between a cable head and the main chamber;

a first tensioned valve system positioned between the pump and the main chamber, the first tensioned valve system configured so that, when the pump is active, liquid communication between the pump and the upper chamber is open while liquid communication between the upper chamber and a port located in the dump bailer longitudinal body is closed, and when the pump is inactive, liquid communication between the pump and the upper chamber is closed while liquid communication between the upper chamber and the port is open;

a second tensioned valve system positioned between a bottom of the main chamber and an outlet at a lower end of the dump bailer, the second tensioned valve system configured so that liquid communication between the lower chamber and the outlet of the dump bailer is open when the pump is active and closed when the pump is inactive;

a filling valve at the bottom of the main chamber configured to allow the flowable material into the lower chamber while preventing flowable material from exiting the lower chamber through the filling valve; and a means for orientation of the dump bailer along a longitudinal axis within the lubricator assembly.

2. The dump bailer according to claim 1, wherein the means for orientation of the dump bailer comprises an inclined lower surface for orientating the dump bailer using a guide with a matching inclined surface.

3. The dump bailer according to claim 2, wherein the inclined surface is a part of a mule shoe.

4. The dump bailer according to claim 1, wherein the filling valve is configured to be opened with a dart.

5. The dump bailer according to claim 1, wherein the pump is a positive displacement pump.

6. A lubricator assembly having a dump bailer with a filling valve located therein, the lubricator assembly being configured to allow filling a flowable material into the dump bailer, the lubricator assembly comprises:

a filling section located at a lower part of the lubricator assembly, the filling section comprises an inlet for injection of flowable material through a wall of the lubricator assembly, a guide below the inlet, and an inlet sealing mechanism for providing a tight liquid communication between the inlet and the dump bailer filling valve; and wherein the guide for providing the dump bailer with a position and an orientation within the lubricator assembly so that the dump bailer filling valve is aligned with the inlet sealing mechanism to provide a tight liquid communication between the inlet and the filing valve; and wherein the inlet sealing mechanism and the guide are operable from outside of the lubricator assembly.

7. The lubricator assembly according to claim 6, wherein the guide comprises an inclined surface for matching an inclined lower portion of the dump bailer.

8. The lubricator assembly according to claim 7, wherein a normal of the inclined surface forms an angle relative to a longitudinal axis of the lubricator assembly for matching a mule shoe on the dump bailer.

9. The lubricator assembly according to claim 7, wherein the lubricator assembly further comprises a wash line inlet and a wash line outlet for washing at least a portion of the dump bailer by injecting a cleaning liquid through the wash line inlet and letting the cleaning liquid out of the wash line outlet, and wherein the inclined surface is configured for guiding the cleaning liquid towards the wash line outlet.

10. The lubricator assembly according to claim 6, wherein the inlet sealing mechanism comprises a seal cup which is displaceable within the inlet of the lubricator assembly towards the filling valve of the dump bailer.

11. The lubricator assembly according to claim 6, wherein the lubricator assembly further comprises a dart through the inlet for opening the filling valve of the dump bailer.

12. A method for filling a flowable material into a dump bailer positioned within a lubricator assembly and for depositing the flowable material in a wellbore, the method comprises the steps of:

positioning and orienting the dump bailer within the lubricator assembly such that a filling valve of the dump bailer is sealing aligned with an inlet of the lubricator assembly;

filling the dump bailer with flowable material through the inlet and filling valve while the dump bailer is within the lubricator assembly;

lowering the dump bailer containing the flowable material into the wellbore to a desired depth; and depositing the flowable material in the wellbore.

13. The method according to claim 12, wherein the method additionally comprises testing at least one valve of the dump bailer while the dump bailer is within the lubricator assembly.

14. The method according to claim 12, wherein the method additionally comprises washing at least a portion of the dump bailer while the dump bailer is within the lubricator assembly.

15. The method according to claim 12, wherein the step of depositing the flowable material in the wellbore comprises simultaneously displacing the dump bailer upwards within the well.

16. The method according to claim 15, wherein the dump bailer comprises a positive displacement pump, and wherein a speed of displacement of the dump bailer is selected to match a deposit rate of the flowable material so that the relative distance between a upper surface of the deposited flowable material and the dump bailer is substantially constant during the step of depositing the flowable material in the wellbore while simultaneously displacing the dump bailer upwards within the well.

17. The method according to claim 16, wherein the method additionally comprises depositing a first portion of the flowable material until a outlet of the dump bailer is covered by the flowable material before the step of depositing the flowable material in the wellbore while simultaneously displacing the dump bailer upwards within the well.

18. The method according to claim 12, wherein the method additionally comprises pulling the dump bailer into the lubricator assembly after the flowable material has been deposited at a desired depth; and repeating the preceding method steps.

19. The method according to claim 18, wherein, for every time the step of lowering the dump bailer containing the flowable material into the wellbore at a desired depth is repeated, the dump bailer is lowered so that a outlet of the dump bailer is immersed into the previously deposited flowable material to such an extent that the outlet of the dump bailer is covered by the previously deposited flowable material, before the step of depositing the flowable material in the wellbore while simultaneously displacing the dump bailer upwards within the well.

* * * * *